US007781654B1

(12) United States Patent
Kamensky

(10) Patent No.: US 7,781,654 B1
(45) Date of Patent: Aug. 24, 2010

(54) STRING INSTRUMENT

(76) Inventor: Jody M. Kamensky, 7047 Brooklane Rd., Chesterland, OH (US) 44026

( * ) Notice: Subject to any disclaimer, the term of this patent is extended or adjusted under 35 U.S.C. 154(b) by 0 days.

(21) Appl. No.: 12/491,955

(22) Filed: Jun. 25, 2009

Related U.S. Application Data

(60) Provisional application No. 61/207,295, filed on Feb. 10, 2009.

(51) Int. Cl.
*G10D 1/08* (2006.01)

(52) U.S. Cl. ..... 84/267

(58) Field of Classification Search ..... 84/267, 84/291, 293
See application file for complete search history.

(56) References Cited

U.S. PATENT DOCUMENTS 5,390,578 A * 2/1995 Raymer ..... 84/291
2003/0217634 A1* 11/2003 Zigounakis ..... 84/293

* cited by examiner

*Primary Examiner*—Kimberly R Lockett
(74) *Attorney, Agent, or Firm*—Anthony M. Del Zoppo; Driggs, Hogg, Daugherty & Del Zoppo Co., L.P.A.

(57) ABSTRACT

A string instrument includes a body portion having a first longitudinal axis, an elongate neck portion having a second longitudinal axis and first and second opposing ends located along the second longitudinal axis, and a fastener that secures one of the first or second ends to the body portion, wherein the first and second axes are misaligned from each other in a same plane.

20 Claims, 6 Drawing Sheets

STRING INSTRUMENT

CROSS REFERENCE TO RELATED APPLICATIONS

This application claims the benefit of priority of provisional patent application Ser. No. 61/207,295, filed on Feb. 10 2009, and entitled "ANSIR," which is incorporated herein in its entirety by reference.

TECHNICAL FIELD

The following generally relates to string instruments.

BACKGROUND

A string instrument generally includes a body portion having longitudinal axis and an elongate neck portion having first and second opposing ends. One of the ends of the neck is attached to the body via a joint such as a glue or bolt, and the neck extends along the longitudinal axis. A headstock is attached to the other end of the neck. A fretboard is attached to the neck, and a plurality of frets are affixed to the fretboard. A bridge is attached to the body along the longitudinal axis. A set of strings are strung along the longitudinal axis and hence the neck between the headstock and the bridge.

Unfortunately, the above-note physical layout of the neck with respect to the body tends to cause the user of the string instrument to re-position the string instrument off a generally vertical or horizontal axis with respect to the ground to position the neck for playing the instrument. Examples are shown in FIGS. 1A, 1B, 2A and 2B. In FIG. 1A, the instrument is held in an ordinary upright vertical position along a vertical axis 100, and in FIG. 1B the instrument is tilted off the vertical axis 100 by the user for a more comfortable position for playing the instrument. In FIG. 2A, the instrument is held in an ordinary horizontal position along a horizontal axis 200, and in FIG. 2B the instrument is tilted of the horizontal axis 200 by the user for a more comfortable position for playing the instrument.

SUMMARY OF THE INVENTION

Aspects of the application address the above matters, and others.

In one aspect, a string instrument includes a body portion having a first longitudinal axis, an elongate neck portion having a second longitudinal axis and first and second opposing ends located along the second longitudinal axis, and a fastener that secures one of the first or second ends to the body portion, wherein the first and second axes are misaligned from each other in a same plane.

In another aspect, a method for aligning a neck of a string instrument with a body of the instrument in a same plane and angularly offset from a longitudinal axis of the body is discussed. The method comprises positioning the instrument in a generally vertical or horizontal position, loosening or removing a fastener securing the neck to the body, pivoting or rotating, with respect to the body and in the plane, the neck out of the generally vertical or horizontal position, and securing the neck to the body via the fastener.

In yet another aspect, a method for determining a desired misalignment between a neck of a string instrument with a body of the instrument is discussed. The method comprises positioning a string instrument simulator having first and second members, respectively corresponding to a neck and body of a corresponding string instrument, in a generally vertical or horizontal position, loosening or removing a fastener securing the first neck member to the second body member, pivoting or rotating, with respect to the second body member and a same plane, the first neck member to a desired angular position, determining an angle of the first neck member with respect to the second body member, and misaligning the neck of the string instrument with respect to the body of the string instrument based on the determined angle.

Those skilled in the art will recognize still other aspects of the present application upon reading and understanding the attached description.

DETAILED DESCRIPTION

The following generally relates to string instruments such as a guitar, violin, cello, viola, bass, mandolin, banjo, harp, and/or other string instruments. However, for brevity and clarity, the following is described in connection with a guitar.

Figure 1A:
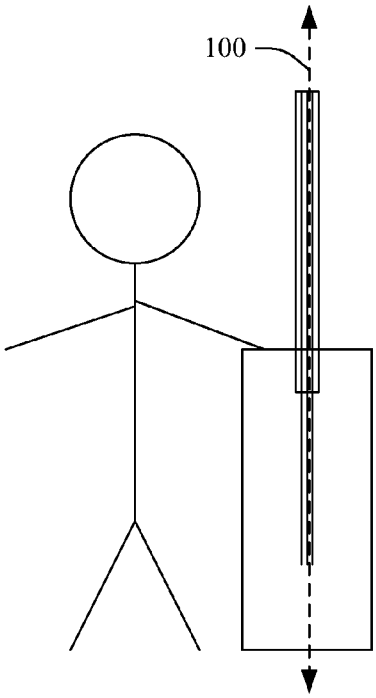
FIGS. 1A, 1B, 2A, and 2B illustrate prior art.
Figure 1B:
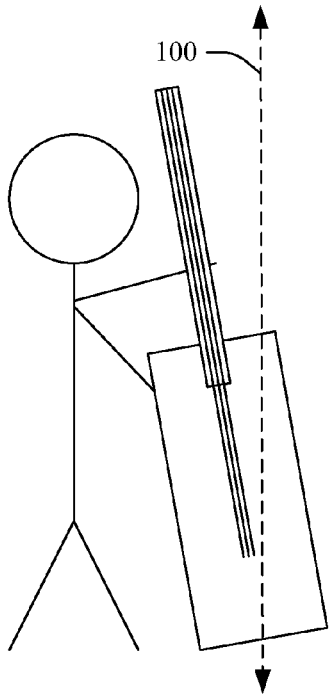
Figure 2A:
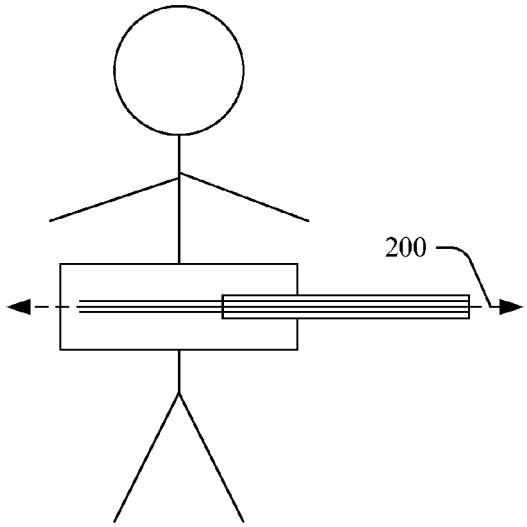
Figure 2B:
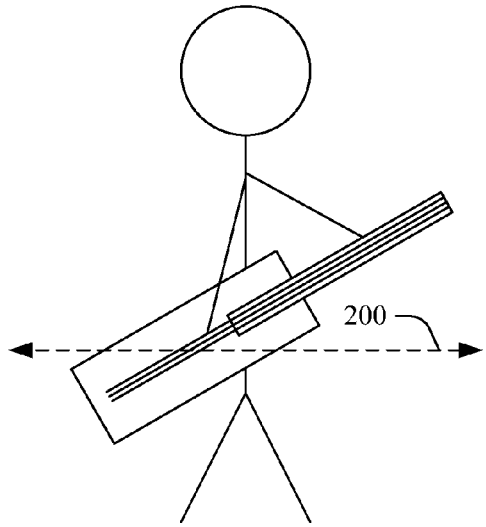
Figure 3:
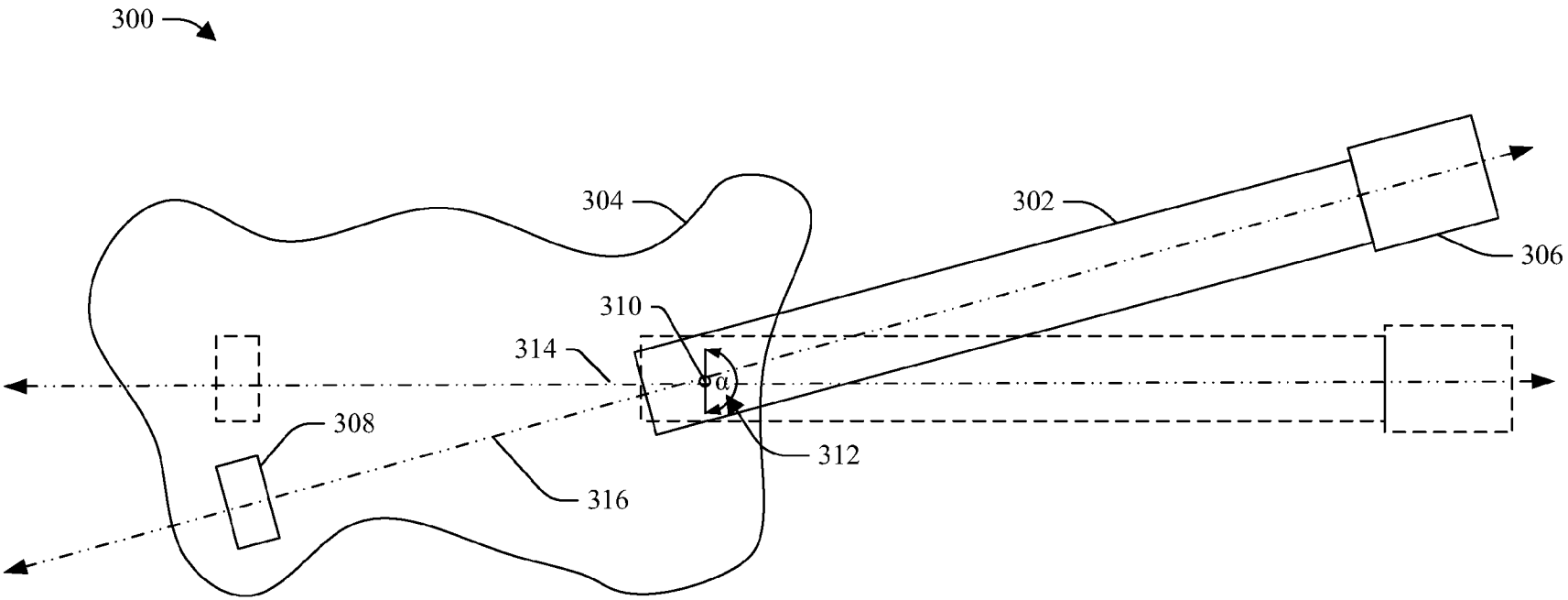
FIGS. 3, 4, 5, and 6 illustrate various non-limiting example embodiments of a string instrument and/or string instrument simulator.

Initially referring to FIG. 3, an example string instrument 300 is illustrated. The string instrument includes a neck 302 and a body 304. The illustrated body 304 has an irregular shape. In other embodiments, the body 304 is otherwise shaped. A headstock 306 is affixed to the neck 302, and a bridge 308 is attached to the body 304. When strings are installed on the string instrument 300, they extend between the headstock 306 and the bridge 308, along the neck 302.

The neck 302 is attached to body 304 via a fastener 310 such as a screw, a bolt, or the like. The fastener 310 secures the neck 302 at a fixed location. The fastener 310 can also be loosened (or removed) to allow the neck 302 to pivot about the fastener 310 (or a pivot point). The illustrated neck 302 can pivot through an angle ($\alpha$) 312, which is in a range of about negative forty-five (−45) to about positive forty-five (+45) degrees with respect to a longitudinal axis 314 of the body 304 which extends along a length of the body 304. The illustrated neck 302 is being transitioned from a first position corresponding to $\alpha=0$ to a second position where $\alpha>0$. In this position, a longitudinal axis 316 of the neck 302, which is in a same plane as the longitudinal axis 314 of the body 304, is misaligned or angularly offset from the longitudinal axis 314 of the body 304 in the same plane.

The bridge 308 is affixed to body 304 based on the angle $\alpha$. In one instance, the bridge 308 is mounted on a slide track and can be slid along the track to a position in accordance with the angle $\alpha$. In another instance, the bridge 308 is removably attached at a fixed location. In this instance, the bridge 308 is removed and re-attached to a suitable position in response to pivoting the neck 302 to a different position. The illustrated bridge 308 is shown being re-positioned in accordance with the neck 302 being moved from the first position ($\alpha=0$) to the second position ($\alpha>0$).

Figure 4:
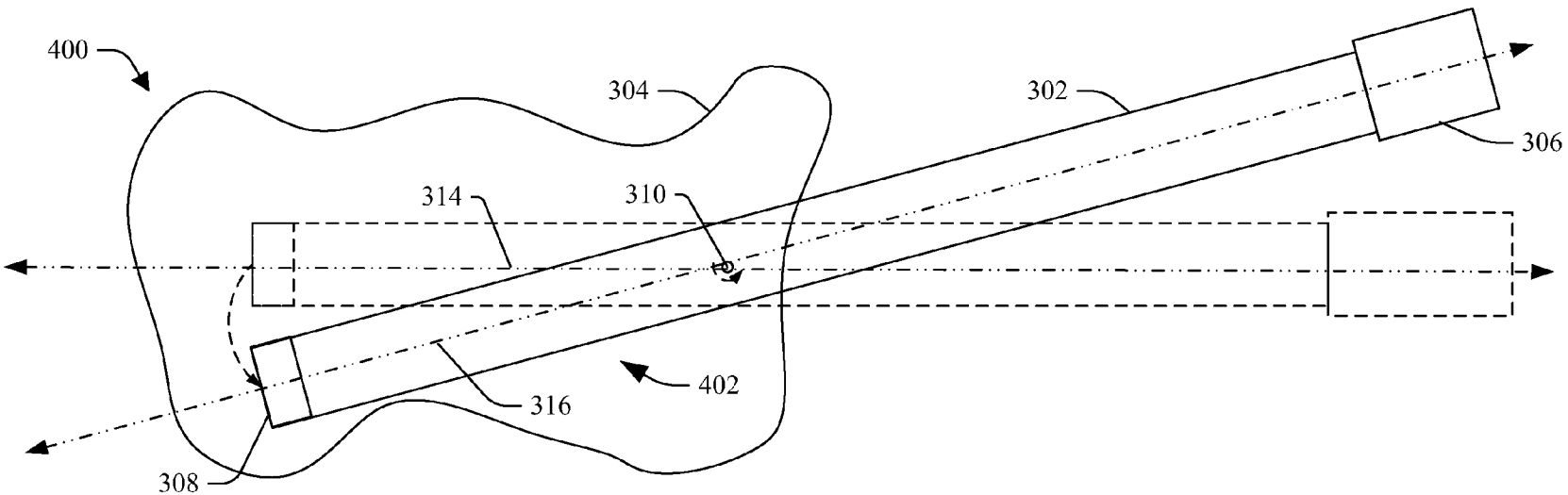

Turning to FIG. 4, a string instrument 400 is substantially similar to the string instrument 300 except that the neck 302 extends and is attached to the bridge 308 to form a single member 402. In this configuration, the neck 302 and bridge move together in coordination as member 402 and hence the neck 302 rotates about the fastener 310 through the angle $\alpha$. As such, the bridge 308 is automatically re-positioned based on the angle $\alpha$ as the neck 302 is re-positioned. Depending on the type of string instrument, pickups and/or other electrical and/or mechanical components may or may not be located on the structure 402 and move with the neck 302 and the bridge 308.

Figure 5:
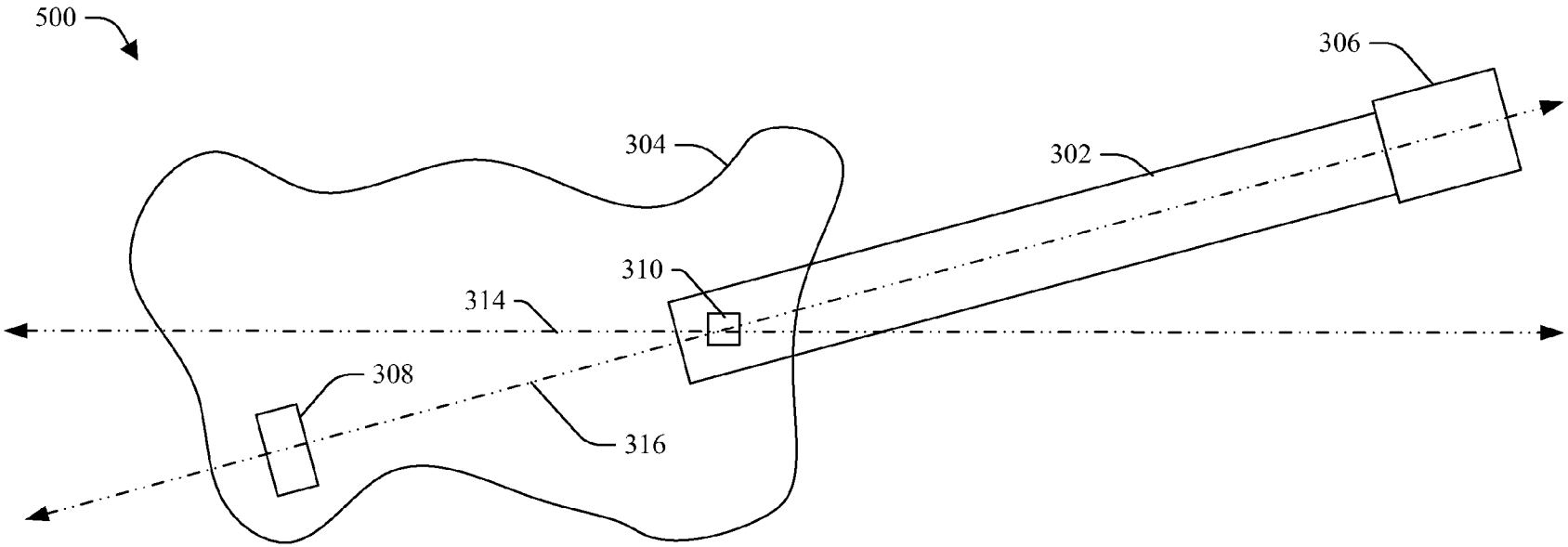

Turning next to FIG. 5, a string instrument 500 is substantially similar to the string instrument 300 except that the neck 302 and the bridge 308 are fixedly mounted to the body 304. In this instance, the fastener 310 can be an adhesive such as a glue, epoxy, etc., a bolt, a rivet, and/or other fastener. The angle $\alpha$ can be predetermined based on the general angle or the particular user.

Figure 6:
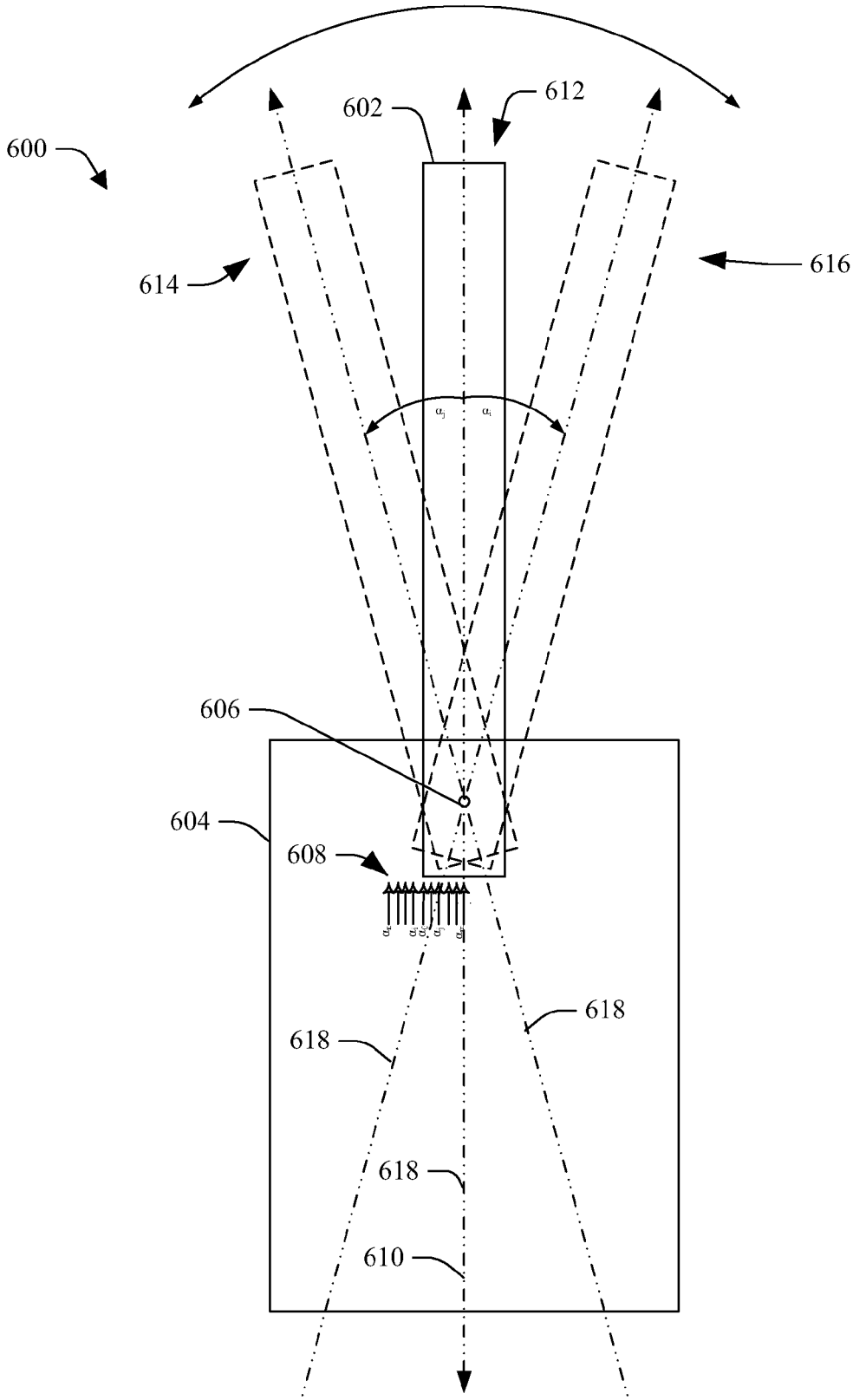

FIG. 6 illustrates a string instrument simulation apparatus 600 for facilitating determining the angle $\alpha$ for a user of a string instrument. The apparatus includes first and second portions 602 and 604, respectively representing the neck and the body of a string instrument.

The neck 602 is pivotally mounted to the body 604 via a fastener 606 (which may be substantially similar to fastener 310) or the like. The fastener 606 allows the neck 602 to be pivoted about the fastener 606 or other pivot and selectively locked at an angle $\alpha$ desired by the user. An angular scale 608 is affixed to the body 604. The scale 608 maps the angular position of the neck 602 with respect to a longitudinal axis 610 of the body 604 and a longitudinal axis of the neck 618. The illustrated scale 608 includes n to m angular positions ($\alpha_n$ to $\alpha_m$).

By way of example, at a position 612, the scale indicates $\alpha=\alpha_0=0$, which corresponds to the angle of a conventional string instrument with a fixed neck. At this position, the longitudinal axes 614 and 618 coincide. At a position 614, the scale indicates $\alpha=\alpha_j>0$, and the longitudinal axis of the neck 602 no longer coincide with the longitudinal axis of the body 604, but instead is angularly offset therefrom. At a position 616, the scale indicates $\alpha=\alpha_i<0$, and again the longitudinal axis of the neck 602 does longer coincide with the longitudinal axis of the body 604, but instead is angularly offset therefrom. The positions 614 and 616 correspond to neck positions as determined by a user of a string instrument to be customized in accordance with preferences of the user. The angular position can then be used when installing a neck on the string instrument.

It is to be appreciated that where the string instrument is an acoustic instrument, the sound hole can be configured based on the angular range of a for the instrument and/or can be adjustable in size and/or location.

Figure 7:
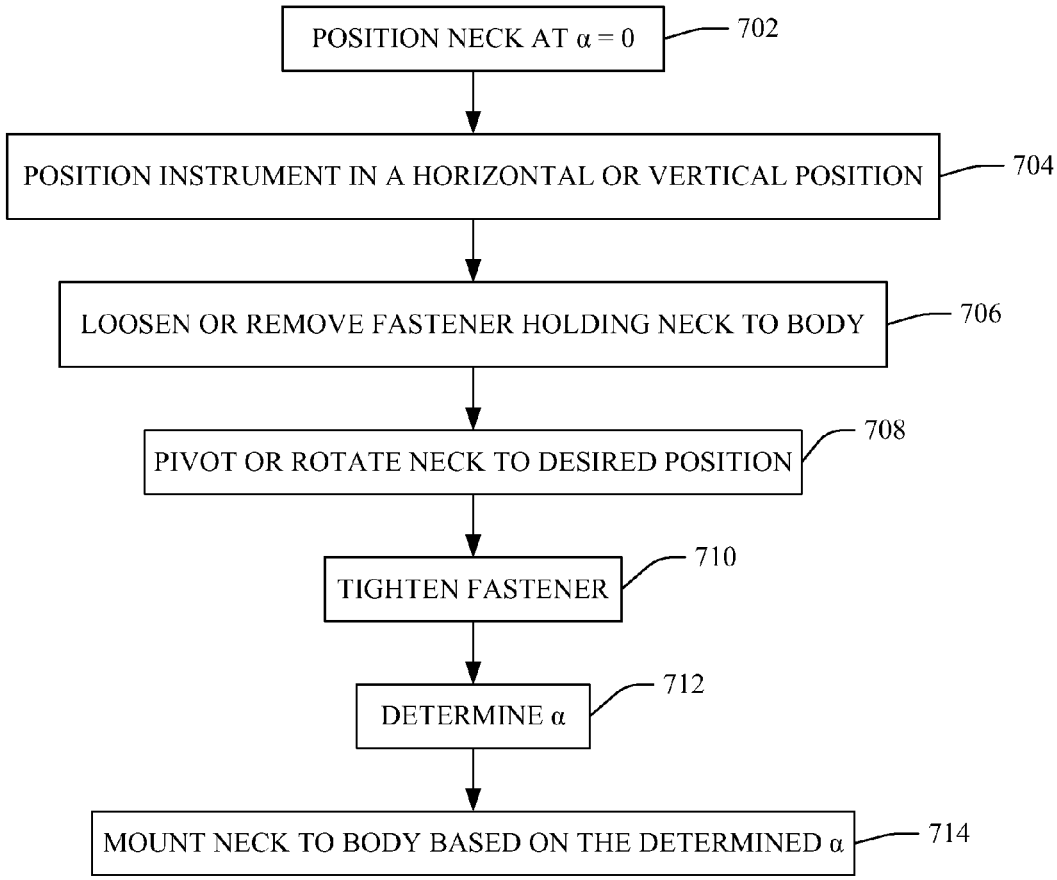
FIGS. 7 and 8 illustrate non-limiting example methods.

FIG. 7 illustrates a method for determining a string instrument neck position for a user of an instrument based on the string instrument simulation apparatus 600.

At 702, the apparatus 600 is configured so that the neck portion 602 is located at an initial reference position at which the angle $\alpha$ is about zero.

At 704, a user positions the apparatus 600 in a generally vertical or horizontal position.

At 706, the fastener 606, which secures the neck 602 to the body 604, is loosened or removed.

At 708, the neck 602 is pivoted or rotated to a desired position, including a position where $\alpha$ is greater or less than zero.

At 710, the fastener 606 is tightened.

At 712, the angle $\alpha$ is determined for the position of the neck 602.

At 714, the angle $\alpha$ is used to mount a neck to an instrument for the user.

Figure 8:
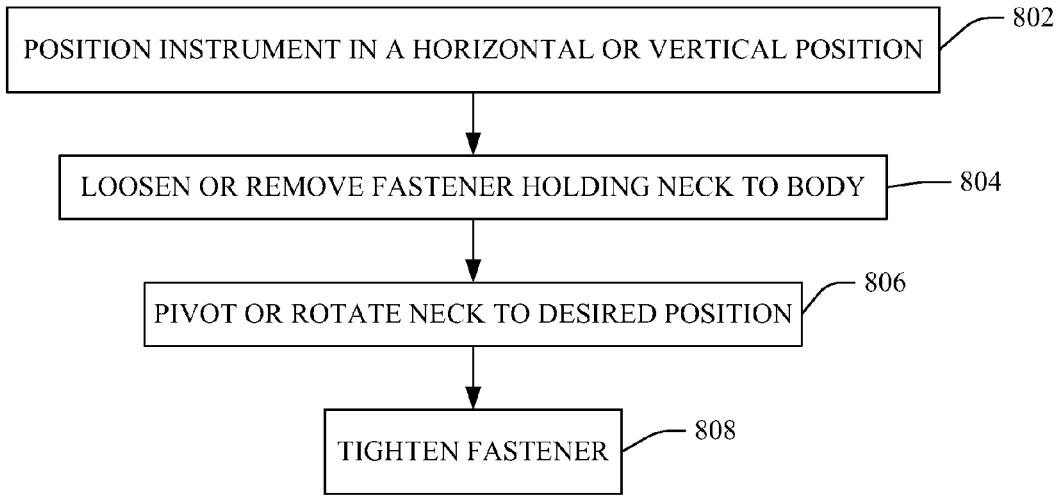

FIG. 8 illustrates a method for setting $\alpha$ string instrument neck position for a string instrument with a pivotal or rotatable neck.

At 802, a user positions the instrument in a generally vertical or horizontal position.

At 804, the fastener 310 securing the neck 302 to the body 304 is loosened or removed.

At 806, the user selectively pivots or rotates the neck 302 about the fastener 310, while keeping the body at the vertical or horizontal position, until at a desired position.

At 808, the fastener 310 is tightened, securing the neck 302 to the body 304 at the desired angle $\alpha$.

The application has been described with reference to various embodiments. Modifications and alterations will occur to others upon reading the application. It is intended that the invention be construed as including all such modifications and alterations, including insofar as they come within the scope of the appended claims and the equivalents thereof.

What is claimed is:

1. A string instrument, comprising:

a body portion having a first longitudinal axis;

an elongate neck portion having a second longitudinal axis and first and second opposing ends located along the second longitudinal axis, wherein the first opposing end is fixedly mounted to the body portion so that the first and second longitudinal axes are in a same plane and are angularly offset from each other in the same plane by a predetermined non-zero fixed angle;

a headstock affixed to the second opposing end of the elongate neck; and a bridge portion mounted to the body portion, with respect to the second longitudinal axis, so that strings installed on the string instrument extend between the headstock and the bridge, along the elongate neck and over the first and second opposing ends.

2. The string instrument of claim 1, wherein the string instrument is one of a guitar, a violin, a cello, a viola, a bass, a mandolin, a banjo, or a harp.

3. The string instrument of claim 1, wherein the angle is in a range of negative forty-five degrees to positive forty-five degrees in the plane with respect to the second axis.

4. The string instrument of claim 1, wherein the elongate neck portion, once affixed to the body portion, does not pivot or rotate relative to the body portion.

5. The string instrument of claim 1, wherein the same plane is parallel to a front side of the body portion and a front side of the elongate neck portion.

6. The string instrument of claim 1, wherein the elongate neck portion is mounted to the body portion so that it cannot move relative to the body portion.

7. The string instrument of claim 1, wherein the angle cannot be changed once the elongate neck portion is fixedly mounted to the body portion.

8. The string instrument of claim 1, furthering including an angular scale affixed to the body, wherein the angular scale includes indicia indicative of a plurality of angular increments corresponding to a plurality of predetermined angles at which the second longitudinal axis alternatively is positioned with respect to the first longitudinal axis.

9. The string instrument of claim 1, wherein the elongate neck portion is fixedly mounted to the body via an adhesive.

10. The string instrument of claim 1, wherein the elongate neck portion is fixedly mounted to the body via at least one bolt.

11. The string instrument of claim 1, wherein the angle is determined prior to fixedly mounting the elongate neck portion to the body portion based on a user preference.

12. The string instrument of claim 1, wherein the angle corresponds to a customized preference of a user of the string instrument.

13. The string instrument of claim 3, wherein a substantial portion of the elongate neck protrudes out and away from the body portion at all angles in the range.

14. The string instrument of claim 13, wherein a zero angle corresponds to a configuration in which the first and second longitudinal axes are parallel, and not angularly offset to each other in the same plane.

15. The string instrument of claim 1, wherein the angle corresponds to an angle comfortable to a user playing the string instrument.

16. A method for determining a desired alignment between a neck of a string instrument with a body of the instrument, the method comprising:

positioning a string instrument simulator having first and second members, respectively corresponding to a neck and body of a corresponding string instrument, in a generally vertical or horizontal position;

loosening or removing a fastener securing the first neck member to the second body member;

pivoting or rotating, with respect to the second body member and a same plane, the first neck member to a desired angular position;

determining an angle of the first neck member with respect to the second body member;

aligning the neck of the string instrument with respect to the body of the string instrument based on the determined angle; and employing an angular scale affixed to the second body member to determine the angle.

17. The method of claim 16, wherein the angle is between negative forty-five degrees and positive forty-five degrees.

18. The method of claim 16, further comprising rotatably affixing the first neck member to the second body member.

19. A string instrument, comprising:

a body portion having a first longitudinal axis;

an elongate neck portion having a second longitudinal axis and first and second opposing ends located along the second longitudinal axis;

a fastener that secures one of the first or second ends to the body portion, wherein the first and second axes are misaligned from each other in a same plane; and an angular scale affixed to the body, wherein the angular scale includes indicia indicative of a plurality of angular increments corresponding to a plurality of predetermined angles at which the second longitudinal axis alternatively is positioned with respect to the first longitudinal axis.

20. A string instrument, comprising:

a body portion having a first longitudinal axis;

an elongate neck portion, fixedly mounted to the body portion, having a second longitudinal axis and first and second opposing ends located along the second longitudinal axis, wherein the first and second longitudinal axes are in a same plane, the first and second axes are angularly offset from each other in the same plane by a non-zero angle, the non-zero angle corresponds to a customized preference of a user of the string instrument, and an angle of zero corresponds to a configuration in which the first and second longitudinal axes are parallel to each other;

a headstock affixed to one of the first or second opposing ends;

a bridge portion that is fixedly mounted to the body portion with respect to the second longitudinal axis so that strings installed on the string instrument extend between the headstock and the bridge, along the elongate neck and over the first and second opposing ends, wherein the strings are affixed to the headstock and the bridge, and a fastener that fixedly mounts the end of the elongate neck portion that is not affixed to the headstock to the body portion, wherein the fastener is an adhesive.

* * * * *